US009475074B2

(12) United States Patent
Auerbach et al.

(10) Patent No.: US 9,475,074 B2
(45) Date of Patent: Oct. 25, 2016

(54) DISCHARGING DEVICE

(71) Applicants: Judith Auerbach, Niederteufen (CH); Thomas Eberhard, Radolfzell (DE); Wilfried Graf, Radolfzell (DE)

(72) Inventors: Judith Auerbach, Niederteufen (CH); Thomas Eberhard, Radolfzell (DE); Wilfried Graf, Radolfzell (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 113 days.

(21) Appl. No.: 14/478,350

(22) Filed: Sep. 5, 2014

(65) Prior Publication Data

US 2014/0374445 A1 Dec. 25, 2014

Related U.S. Application Data

(62) Division of application No. 12/925,045, filed on Oct. 12, 2010.

(30) Foreign Application Priority Data

Oct. 13, 2009 (DE) ..... 10 2009 049 903

(51) Int. Cl.
*B67D 1/00* (2006.01)
*B05B 11/00* (2006.01)

(52) U.S. Cl.
CPC ..... *B05B 11/0027* (2013.01); *B05B 11/3059* (2013.01); *B05B 11/3091* (2013.01); *B05B 11/0032* (2013.01); *B05B 11/0059* (2013.01); *B05B 11/30* (2013.01)

(58) Field of Classification Search
CPC ..... B05B 11/0027; B05B 11/3059; B05B 11/3092; B05B 11/0032; B05B 11/0059; B05B 11/30
USPC ..... 222/153.13, 153.14, 153.04
See application file for complete search history.

(56) References Cited

U.S. PATENT DOCUMENTS

| | | | | |
|---|---|---|---|---|
| 2,847,139 | A | 8/1958 | Christiansson et al. | |
| 3,405,843 | A | 10/1968 | Watson, Jr. | |
| 5,462,181 | A * | 10/1995 | Glynn | B65D 50/04 215/204 |
| 6,364,166 | B1 * | 4/2002 | Ritsche | B05B 11/0027 222/153.13 |
| 6,527,144 | B2 | 3/2003 | Ritsche et al. | |
| 6,708,846 | B1 * | 3/2004 | Fuchs | A61M 11/06 222/327 |
| 7,857,169 | B2 | 12/2010 | Harrold | |
| 2004/0011819 | A1 | 1/2004 | Jennings et al. | |
| 2007/0145077 | A1 | 6/2007 | Harrold | |
| 2008/0149098 | A1 | 6/2008 | Bonney et al. | |
| 2008/0237264 | A1 | 10/2008 | Auerbach et al. | |
| 2009/0294476 | A1 * | 12/2009 | Koenig | B05B 11/02 222/182 |
| 2010/0294807 | A1 | 11/2010 | Stradella | |
| 2013/0068797 | A1 | 3/2013 | Laidler et al. | |

* cited by examiner

*Primary Examiner* — Patrick M Buechner
*Assistant Examiner* — Jeremy W Carroll
(74) *Attorney, Agent, or Firm* — Flynn, Thiel, Boutell & Tanis, P.C.

(57) ABSTRACT

A discharging device for discharging liquids includes an outer housing encompassing an inner chamber, a liquid storage receptacle, a discharge orifice, a delivery device for delivering liquid from the storage receptacle to the discharge orifice, a cap that covers the discharge orifice when present on the outer housing in a safety position, and a manual actuator adapted to actuate the delivery device and which is movable relative to the outer housing between a neutral relative position and an actuated relative position. The cap and the manual actuator cooperate so that displacement of the manual actuator is mechanically blocked when the cap is in its safety position. A locking element that is movable in relation to the outer housing is constrainedly coupled with the movement of the manual actuator and extends in the actuated position through a hole in the outer housing to a region that the cap blocks when mounted in its safety position.

17 Claims, 6 Drawing Sheets

DISCHARGING DEVICE

CROSS REFERENCE TO RELATED APPLICATION

This is a divisional of prior U.S. application Ser. No. 12/925,045, filed Oct. 12, 2010, which claims the priority of the German patent application No. 102009049903.2, the disclosures of which are hereby incorporated by reference in their entirety.

FIELD OF THE INVENTION

The invention relates to a discharging device for the discharge of liquids, more particularly pharmaceutical liquids, which discharging device comprises an outer housing encompassing an inner chamber, a liquid storage receptical, a discharge orifice, a delivery device for the delivery of liquid from the liquid storage receptical to the discharge orifice, a cap that covers the discharge orifice when placed on the outer housing in a safety position, and a manual actuator that is adapted to actuate the delivery device and can be moved from a neutral position to an actuated position and vice versa relatively to the outer housing. The cap and the manual actuator cooperate in such a way that displacement of the manual actuator is blocked mechanically as long as the cap is in its safety position.

BACKGROUND OF THE INVENTION

Generic discharging devices are known in the prior art. Their distinctive feature consists in that actuation is not possible when the cap is in place on the discharging device. Accidental actuation of the discharging device is thus effectively prevented.

An example of a generic discharging device is disclosed in EP 1 051 262 B1. The discharging device shown and described in this reference comprises two extensions on a cap that extend into the discharging device through holes provided on an outer housing of the discharging device and that block displacement of the manual actuator when the cap is placed on the discharging device at least to the extent that a full discharging operation is not possible.

Despite the actuation-proof action of the cap, the discharging device disclosed in EP 1 051 262 B1 is not suitable as an effective protection against improper actuation of the discharging device by children, since the extensions provided on the cap prevent the use of a more complex type of cap such as a child-proof screw cap. There is therefore a high risk of children successfully removing the cap from the outer housing or lifting the cap from its safety position by applying great force to the manual actuator and thus being able to gain access to the pharmaceutical liquid that will then be dischargeable.

SUMMARY OF THE INVENTION

It is an object of the invention to develop a generic discharging device to the effect that it allows more secure protection against improper use by children and/or allows more flexibility in the use of different types of caps.

This object is achieved, according to the invention, in that at least one locking element is provided that is displaceable relatively to the outer housing and the movement of which in relation to the outer housing is constrainedly coupled to the movement of the manual actuator, this locking element extending, at least in the actuated position of the manual actuator, through a hole in the outer housing into a cap region, in which the cap is disposed in its safety position.

Thus in one design of the invention, the locking element that serves to create the constrained coupling between the cap and the manual actuator is not provided on the cap, but instead is attached to the manual actuator or is at least constrainedly coupled to the same. Thus, following the removal of the cap, the locking element remains on the discharging device, which is then ready for use, and is protected from damage at least partially by the outer housing of the discharging device.

The locking element and the hole in the outer housing, through which the locking element protrudes into the cap region when the manual actuator is actuated, are adapted to suit the cap in such a way that when the cap is disposed in its safety position the locking element collides with the cap when the manual actuator is actuated but before a full discharging operation can be effected. For the purposes of the present invention, the term "safety position" is regarded as being the end position of the cap when placed on the outer housing. The hole preferably has a size that is only slightly larger than the cross-section of the locking element, since the locking element is preferably only moved through the hole without having to be moved transversely to the direction of extension within the hole.

Due to the fact that the locking element is not provided on the cap, no special demands are made on the cap. The cap can thus assume all conventional forms known in the prior art and can also be adapted to be fitted on the outer housing and removed from the same by means of a movement other than a linear movement. The cap can thus be in the form of a screw-threaded cap, for example, comprising a male thread by means of which the cap can be screwed into a female thread provided on the outer housing of the discharging device. A screw-threaded cap of such type poses a considerable hurdle for small children and it also cannot be overridden by applying considerable force to the manual actuator particularly due to the self-locking action of the screw threads.

The delivery device of a discharging device of the invention is preferably in the form of a pump that comprises a pump chamber, the contents of which can be pressurized by applying force to the manual actuator. The displacement of the manual actuator as a result of the manual application of force preferably takes place against the force of a return spring. The delivery device and the return spring can be part of a pump-type disperser included in the discharging device.

It is particularly advantageous when the screw-threaded cap is in the form of a screw-threaded safety cap and, as such, comprises an internal portion comprising the screw thread and an external portion that is accessible from the exterior and that can be displaced axially relatively to the internal portion for being coupled to the internal portion for rotation therewith. As a result, a higher degree of safety is achieved which makes it difficult for children, and more particularly small children, to discharge the medium from the discharging device.

Furthermore, it is of particular advantage that the locking element is formed such that it is disposed, at least partly, in the hole in the outer housing both in the actuated position and in the neutral position of the manual actuator in relation to the outer housing. As a result, the hole is always closed so that dirt is prevented from entering the same. In particular, such an arrangement of the locking element being permanently in the hole makes it unnecessary to carry out additional operations for the purpose of inserting the locking element into the hole during operation of the discharging device once the locking element has been into the hole during the assembly operation and there is thus no fear of the locking element becoming wedged in the hole.

The locking element can be moved indirectly by the manual actuator, for example, in order to have a speed or direction of movement that differs from that of the manual actuator. However, it is regarded as being particularly advantageous when the locking element is attached to the manual actuator so as to be immovable relatively thereto or when the locking element is integrally molded on a main portion of the manual actuator, since this enables the cap in its safety position to have a particularly direct effect on the mobility of the manual actuator. In such designs, the locking element always directly follows the movement of the manual actuator. When the locking element cannot be moved any further due to the cap being in position on the discharging device, it is also not possible to move the manual actuator any further so that a discharging operation cannot take place.

Furthermore, it is of particular advantage when two locking elements are provided such that each extends through opposite holes in the outer housing one on each side of the discharge orifice at least in the actuated position of the manual actuator. A higher degree of safety is achieved as a result of this design comprising two locking elements. Of particular advantage is a design, in which two finger rests are provided on the outer housing at positions opposite to each other one on each side of the discharge orifice and that are disposed such that they are offset, preferably by 90°, in the circumferential direction in relation to the holes.

Furthermore, the invention relates to a generic discharging device in which at least one locking extension extending in a pull-off direction of the cap is provided on the cap, which locking extension extends through a hole in the outer housing in the safety position of the cap for the purpose of causing the mechanical actuator to be blocked in the inner chamber. The locking extension is adapted to match the hole such that total separation of the cap from the outer housing in the pull-off direction starting from the safety position is possible only when the cap has been displaced beforehand relatively to the outer housing in an orthogonal plane oriented orthogonally to the pull-off direction so as to move from a locked state, corresponding to the safety position, to the released state.

This design of the invention can thus resemble the design disclosed in the aforementioned EP 1 051 262 B1. Particularly, in order to make it difficult for children to remove the cap and thus actuate the manual actuator, the cap cannot be removed by pulling it off in the pull-off direction preferably corresponding to the main direction of extension of the discharging device without also displacing the cap transversely to the pull-off direction as it is being removed. For example, provision can be made for having to initially displace the cap and, with it, the locking extension translatively in a direction parallel to the orthogonal plane in order only then to allow the removal of the cap in the pull-off direction. The term "displacement of the cap parallel to the orthogonal plane" is understood to mean a displacement, in which at least all components of the cap that are accessible from the exterior when the cap is in position on the discharging device are jointly non-destructively displaced to the same extent and as a whole. However, provision can also be made for those parts of the cap that extend into the outer housing of the discharging device to be displaced to a lesser degree by deflection. This is explained below in greater detail.

The locking extension formed in accordance with this design performs a dual function as proposed by the invention. Firstly, it serves to block the manual actuator as disclosed in EP 1 151 262 B1. Secondly, it is adapted to match the hole such that the removal of the cap from the outer housing requires a complex sequence of movements that are for children difficult to comprehend.

A design, in which the locking extension comprises a main portion which, in the locked position of the cap, is aligned with the hole in the pull-off direction, and an undercut portion that is attached to, preferably molded on, the locking extension and that is not aligned with the hole in the pull-off direction in the locked position of the cap, is particularly advantageous. Thus an undercut portion is provided on the locking extension, which undercut portion together with the outer housing or portions of the outer housing that are immovable relatively thereto forms an undercut that impedes the cap from being merely pulled off in the pull-off direction without a movement of the cap in the orthogonal plane. Only when the undercut shoulder is aligned with the hole is it possible to remove the cap.

Of particular advantage is a design, in which a force-applying member, particularly a resilient force-applying member, is provided that applies a counteracting force to the cap, which force counteracts the displacement of the cap from the locked state to the released state. This particularly prevents the cap from being automatically moved to its released state, for example, by means of forces acting on the entire discharging device during movement thereof, in which case it could easily be opened even by a child. Such a counteracting force poses a serious obstacle to a small child attempting to remove the cap from the outer housing.

Particular preference is given to a force-applying member that is provided in the form of a resiliently deflectable fin that is attached either to the outer housing or is immovable relatively thereto or is attached to the cap. It is particularly advantageous when the force-applying member is provided in the form of a resiliently deflectable fin on the locking extension of the cap. This deflectable fin is resiliently deflected, particularly by means of a counterpart that is immovable relatively to the outer housing during a displacement of the cap from the locked state to the released state. It is likewise feasible for the counterpart that is immovable relatively to the outer housing also to be resiliently deflectable. Such a design comprising a resiliently deflectable fin is very easy to produce, since no separate components are required for this purpose.

Of particular advantage is a design in which the cap and the outer housing are mutually configured such that the displacement of the cap from its locked state to its released state is possible only when the cap has first been displaced in the pull-off direction starting from the safety position. This can be achieved, for example, by means of the shape of the locking extension or alternatively by any other elements provided on the cap, or on the outer housing, for positively counteracting such a displacement. The advantage of this design is that it is very difficult for a child, more particularly for a small child, to comprehend that the cap has to be moved in three different phases beginning with a movement in the pull-off direction while retaining its locked state and continuing with a movement in the orthogonal plane until the released state is achieved before it is possible to continue displacement of the cap in the pull-off direction. Preferably, the cap must be moved by at least 2 mm, more preferably by at least 4 mm, relatively to the outer housing while retaining the locked state before it can be moved in the orthogonal plane to achieve the released state. Since lifting the cap through the aforementioned 2 mm or 4 mm restricts the mobility of the manual actuator in relation to the outer housing, it is regarded as being preferable to limit this displacement distance to such effect that the displacement of the manual actuator from its neutral state through this distance does not cause any discharging operation to take place.

In a particularly preferred design of the invention, a plurality of locking extensions is provided on the cap, to each of which a hole in the outer housing is assigned. In this case it is preferred that each of the locking extensions and the assigned holes be mutually configured such that all of the locking extensions can be displaced relatively to the respective holes from the locked state to the released state by rotating the cap about a rotation axis extending parallel to the pull-off direction. Such a design can be achieved, for example, in that undercut portions provided on two opposing locking extensions disposed on the cap one on each side of the discharge orifice, extend in opposite directions. Thus a rotational movement for transferring the cap from its locked position to its released state causes all the undercut portions to be simultaneously aligned with the respective holes so that it is then possible to remove the cap. A rotational movement is primarily advantageous since it can take place in the same direction, preferably in the clockwise direction as viewed from above the cap, irrespective of the manner in which the discharging device is being held by the patient.

BRIEF DESCRIPTION OF THE DRAWINGS

Additional aspects and advantages of the invention are revealed by the claims and the following description of exemplary embodiments of the invention in conjunction with the drawings. Individual features of different described embodiments can be combined with each other in any manner without surpassing the frame and scope of the invention.

DETAILED DESCRIPTION OF THE INVENTION

Figure 1:
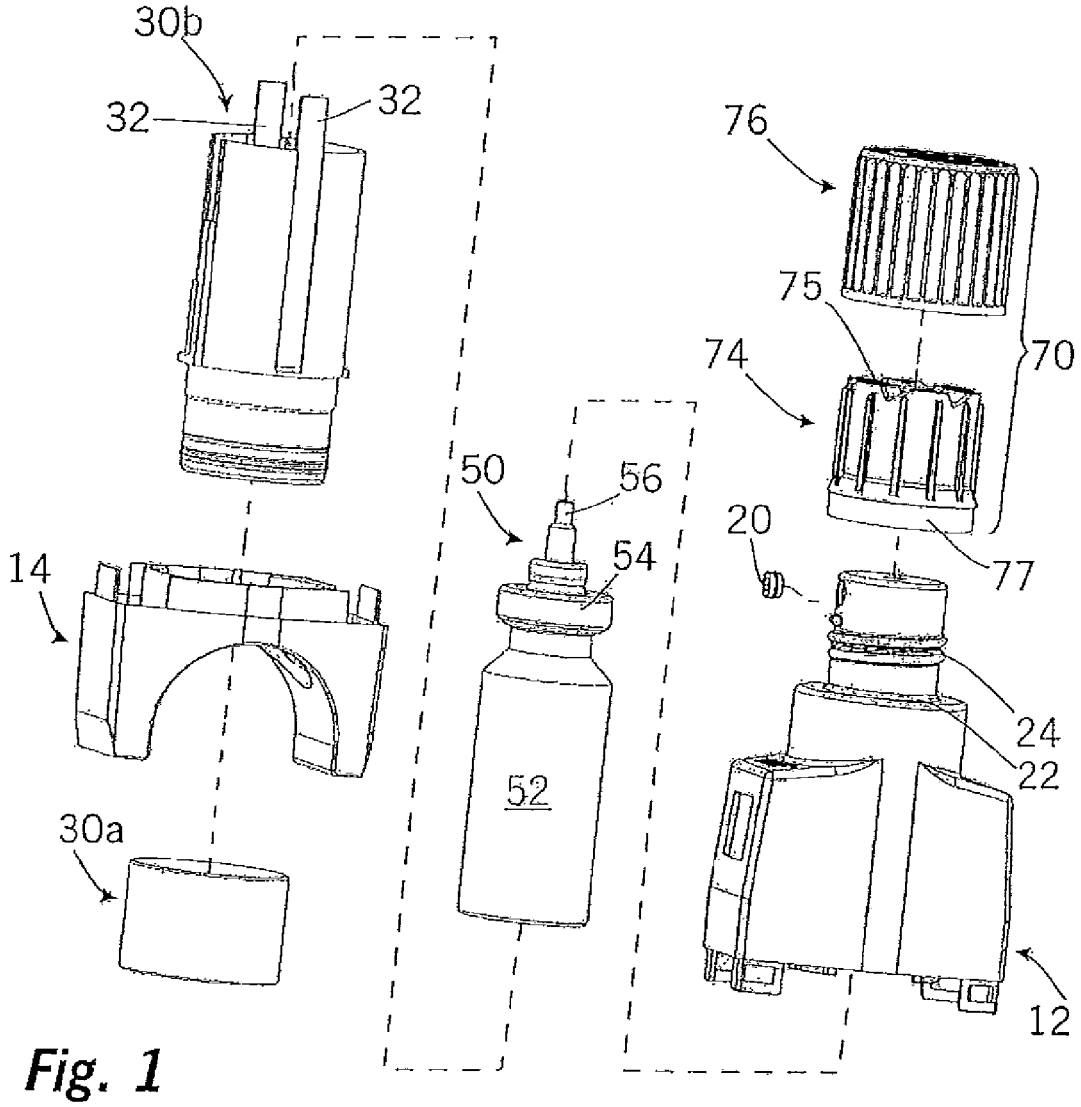
FIG. 1 is an exploded view of a first embodiment of a discharging device of the invention.

FIG. 1 and FIGS. 2*a*-2*c* show a first embodiment of a discharging device of the invention.

The subcomponents of this first embodiment are explained below with reference to FIGS. 1 and 2*a*. The discharging device of the invention comprises a housing 10 that is composed of two permanently interconnected sections 12, 14. A manual actuator 30 comprising two sections 30*a*, 30*b*, which are immovable relatively to each other during operation, is disposed in this housing so as to be movable in the direction of the arrow 2. The manual actuator 30 is approximately cup-shaped and it accommodates a pump-type dispenser 50 that comprises (in a manner not illustrated) a liquid storage receptacle 52, a pumping device 54 and an outlet connector 56 that is displaceable relatively to the liquid storage receptacle 52. The pumping device 54 is adapted to be actuated by means of a relative displacement of the outlet connector 56 in the direction of the liquid storage receptacle 52 against the force of a return spring provided in the pump-type dispenser. The outlet connector 56 is inserted in an attachment 16 molded on the housing 10. A liquid passageway 18 leading to the discharge orifice 20 extends through the attachment 16.

The discharging device is adapted to bring about a discharging operation by means of a manually forced displacement of the manual actuator 30 and thus of the liquid storage receptacle 52 of the pump-type dispenser 50 relatively to the housing 10 and thus relatively to the outlet connector 56 permanently fixed in the housing 10. As a result of the progressive displacement of the manual actuator, a pump chamber in the pump-type dispenser 50 is continuously compressed so that liquid is pressed out of the pump chamber in the direction of the outlet connector 56. The liquid discharged by the outlet connector 56 flows into the passageway 18 and is thus caused to pass to the discharge orifice 20.

Figure 2A:
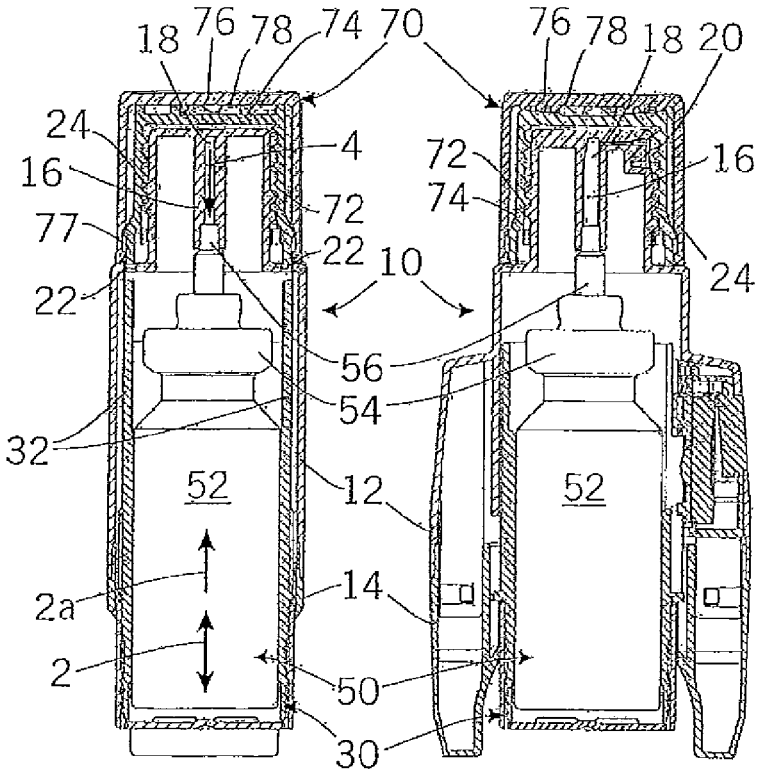
FIG. 2*a* shows sectional views of the discharging device of FIG. 1 in a locked state.

As particularly shown in the illustration in FIG. 1 and the left-hand part of FIG. 2*a*, two locking elements or extensions 32 extending in the direction of holes 22 in the housing 10 are integrally formed on the manual actuator 30. In the locked state shown in FIG. 2*a* and in the unlocked and neutral states shown in FIG. 2*b*, these extensions 32 do not project beyond the holes 22.

Figure 2B:
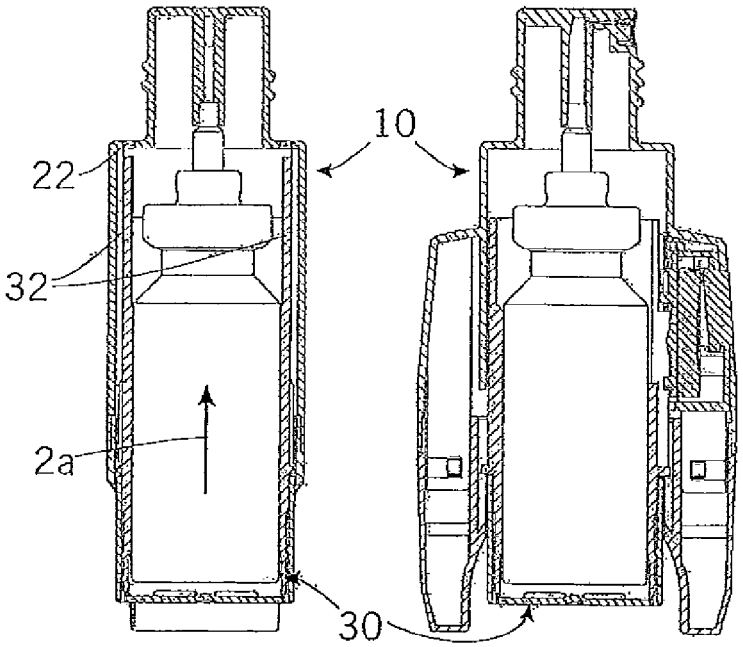
FIG. 2*b* shows sectional views of the discharging device of FIG. 1 in an unlocked neutral state.
Figure 2C:
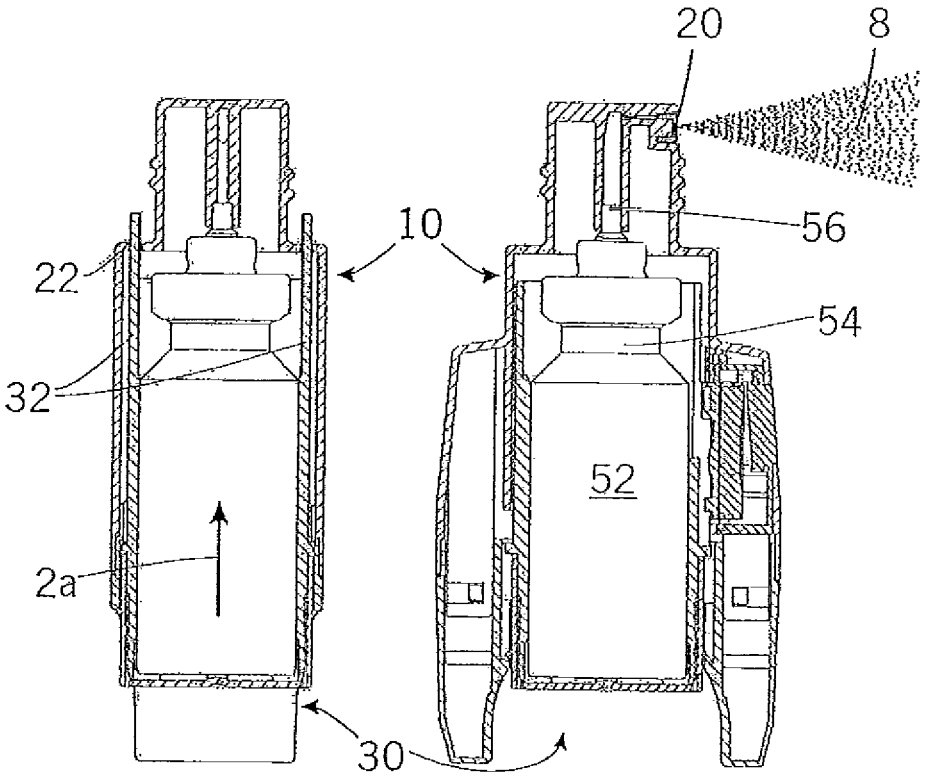
FIG. 2*c* shows sectional views of the discharging device of FIG. 1 in an actuated state.

A safety cap 70 is provided for locking the discharging device shown in FIG. 1 and in FIGS. 2*a* to 2*c*. The safety cap is in the form of a screw cap and comprises, for this purpose, a female thread 72 that is adapted to cooperate with a male thread 24 provided on the housing 10.

The female thread 72 is provided on an internal component 74 of the cap 70. The internal component 74 is not directly accessible from the exterior but is instead shielded by an external component 76. This external component 76 is displaceable relatively to the internal component 74 in the direction of the arrow 4. Lugs and holes that cooperate positively are provided on the end surface 75 of the internal component 74 and on the complementary internal surface 78 of the external component 76, which lugs and holes create a positive fit between the external and internal components when force is applied to the external component 76 in the direction of the internal component 74. As a result of this positive fit, the two components 74, 76 are interconnected for co-rotation so that rotation of the external component 76 about the axis defined by the arrow 4 causes the internal component 74 to be rotated and thus the cap 70 to be totally unscrewed from the male thread 24 of the housing 10.

The surface of the internal component 74 that is oriented toward the housing 10 comprises a circumferential safety flange 77. In the locked state shown in FIG. 2*a*, the safety flange 77 rests against the surface of the housing 10. The flange 77 is formed such that it is disposed directly above the holes 22 in the locked position of the cap 70 shown in FIG. 2*a*.

This arrangement blocks any movement of the manual actuator 30 in relation to the housing 10 in the direction of the arrow 2*a* when the cap 70 is in the locked position as shown in FIG. 2*a*. Displacement of the manual actuator 30 is prevented in that during an attempt to do so, the extensions 32 collide with the cap 70, more precisely with the locking flange 77, as the manual actuator is displaced. A discharging operation can thus not be effected when the cap 70 is in position on the discharging device.

Only when the cap 70 has been unscrewed, and thus the state shown in FIG. 2*b* has been achieved, is it possible to displace the manual actuator 30 relatively to the housing 10 in the direction of the arrow 2*a* by means of a force applied to the manual actuator 30 such that a discharging operation of the type described above is achieved, that is to say, that a spray jet 8 is discharged through the discharge orifice 20. As shown in the illustration on the left-hand side of FIG. 2*c*, the extensions 32 are pushed upwardly out of the holes 22 during the discharging operation, this being possible without any obstruction because the cap 70 has been removed.

FIG. 3 and FIGS. 4*a*-4*d* show a second embodiment of a discharging device of the invention. In this regard, the basic construction of the second embodiment of the discharging device will first be explained with reference to the illustrations in FIGS. 3 and 4*a*.

As in the first embodiment described above, this second embodiment of the discharging device likewise comprises a housing 110, in which a manual actuator 130 is mounted so as to be displaceable in the direction of the arrow 102*a*. Furthermore, the housing 110 likewise comprises a discharge orifice 120 that can communicate with a fluid storage receptacle 152 by way of a connecting passageway 118. However, unlike the design shown in FIG. 1, the liquid is not caused to flow by means of a piston pump, but instead the liquid storage receptacle 152 is displaced upwardly in the direction of the arrow 102*a* by the manual actuator 130 via an intermediate member 160, thus causing a hollow needle, which is immovable in relation to the discharge orifice 120, to pierce through a stopper 158 of the liquid storage receptacle 152. The stopper 158 reduces the volume of the liquid storage receptacle 152 as displacement of the latter is continued, and thus causes a discharging operation to take place through the discharge orifice 120.

As is also the case in the embodiment shown in FIGS. 1 and 2*a*-2*c*, the discharging device shown in FIG. 3 and FIGS. 4*a*-4*d* comprises a cap 170 that is adapted to cooperate with the manual actuator 130 in such a way that a discharging operation cannot be effected when the safety cap 170 is in position on the discharging device in its locked state. To achieve this, the cap 170 is provided with two locking extensions 172, for each of which complementary holes 122 are provided in the housing 110. Those portions of the housing in the illustration shown in the left-hand part of FIG. 4*a* that define the holes are emphasized by thicker lines in the drawing. The lower ends of these locking extensions reach down to the manual actuator 130 and thus impede displacement of the manual actuator in the state shown in FIG. 4*a*, in which the cap is in its locked position.

Figure 3:
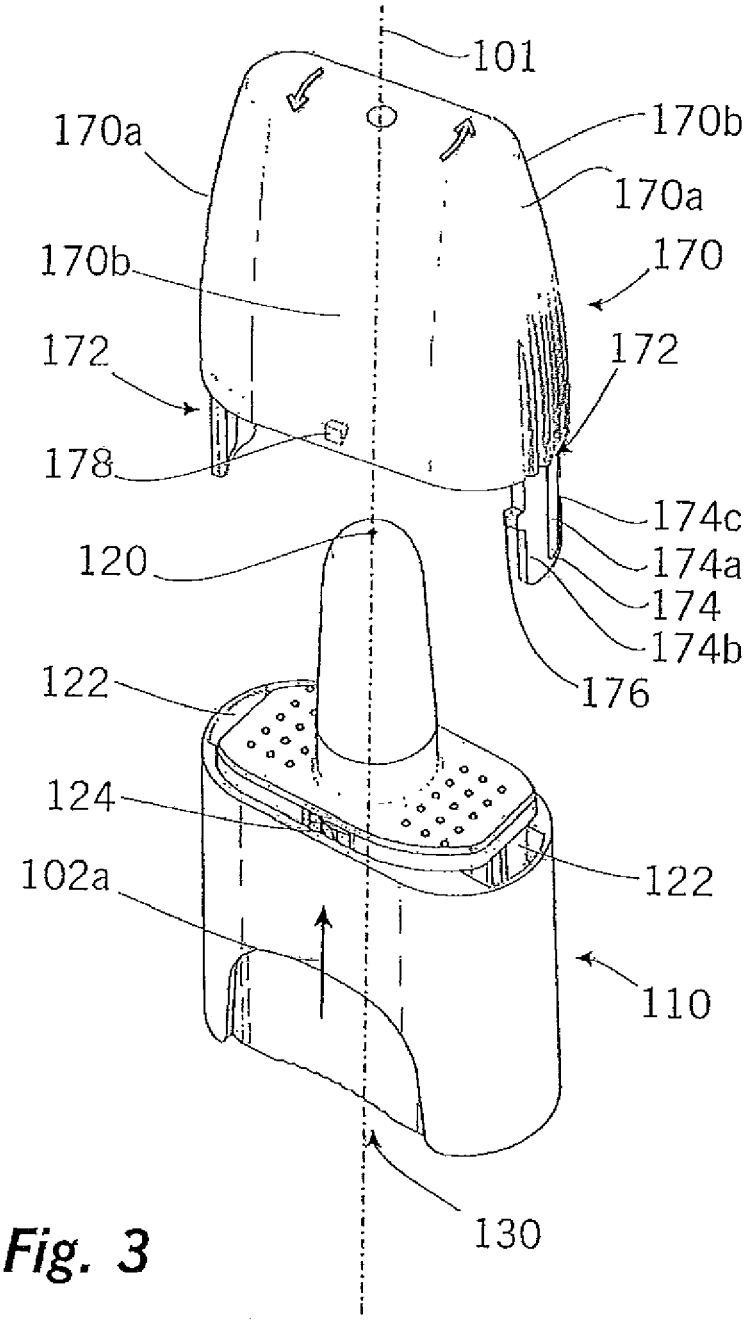
FIG. 3 shows a second embodiment of a discharging device of the invention.

As is evident particularly from FIG. 3, the locking extensions 172 comprise a main portion 174, the width of which is not greater than the width of the hole 122 and which is attached to the cap 170 so as to be aligned with the respective associated hole 122 in the housing 110 in the safety position of the cap. A hole 174*a* is provided at the side of the main portion 174. As a result of the eccentric arrangement of this hole 174*a*, the latter divides the main portion 174 into a main fin 174*b* that is difficult to deform due to its width, and a narrow resilient fin 174*c*. On the side of the main fin 174*b*, an undercut portion 176 is molded that is not aligned with the corresponding hole 122 in the safety position of the cap 170 on the housing 110, as explained below.

As is evident from FIG. 3, both of the locking extensions 172 are formed in accordance with the above description. However, they are each oriented in such a way relative to a main axis 101 that the undercut portions 176 each extend from the main portions in the counterclockwise direction, as viewed from the front.

An additional safeguard against the removal of the cap 170 is provided by lateral depressions 124 provided in a mirror-inverted manner on the housing 110, into which depressions inwardly oriented catches 178 that are attached to the cap 170 extend when the cap 170 is placed on the discharging device. The catches 178 can be removed from the depressions 124 in that the short sides 170*a* of the cap 170 are pressed toward each other so that the long sides 170*b* bulge out, and thus the catches 178 move outwardly.

FIGS. 4*a* to 4*d* show the hindrance posed by the locking extensions 172 to the removal of the cap 170, which hindrance prevents children, more particularly small children, from being able to successfully pull off the cap.

Figure 4A:
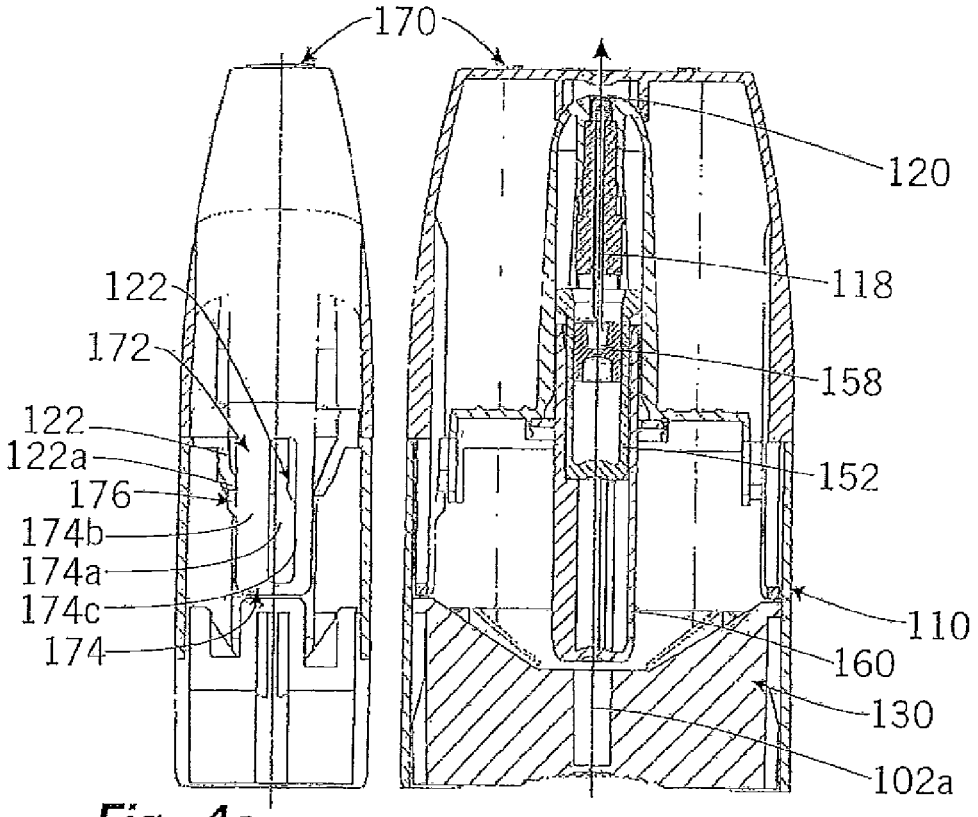
FIG. 4*a* shows sectional views of the discharging device of FIG. 3 in a locked state.

FIG. 4*a* shows an initial position in which the cap 170 is placed on the housing 110 in a safety position. It is not possible to directly pull off the cap 170 from this initial position in the direction of the arrow 102*a* since the undercut portion 176 rests in this state against a portion 122*a* that is fixed to the housing and is located at the edge of the hole 122.

A removal of the cap 170 is possible only when the undercut portions 176 have been displaced in the direction of the arrow 106*a* extending transversely to the pull-off direction 102*a* relatively to the portion 122*a* fixed to the housing. For this purpose, the cap 170 is substantially rotated as a whole unit about the main axis 101 in the clockwise direction. During rotation of the cap, the catches 178 on the cap 170 move within the recesses 124 of the housing, but do not leave the recesses 124.

Figure 4B:
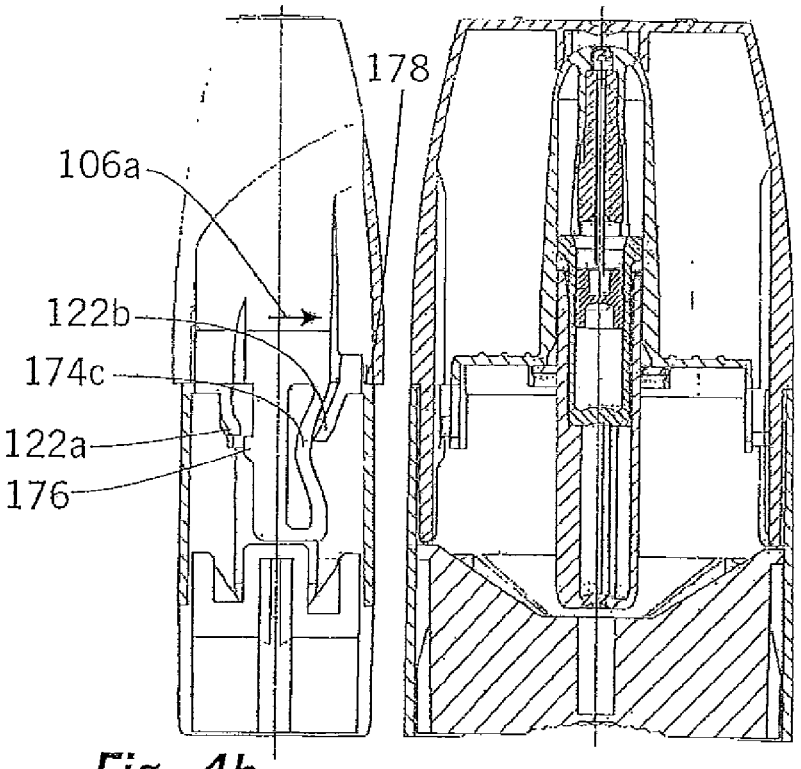
FIG. 4*b* shows sectional views of the discharging device of FIG. 3 with force applied for rotation of a cap.

As seen in FIG. 4*b*, the rotation of the cap 170 about the axis 101 is only possible by pressing against a counteracting force. This is achieved by the resilient deformation of the fin 174*c* when the latter is pressed against a portion 122*b* that delimits the accommodating opening on the right side thereof as shown in FIGS. 4*a* to 4*d*.

Figure 4C:
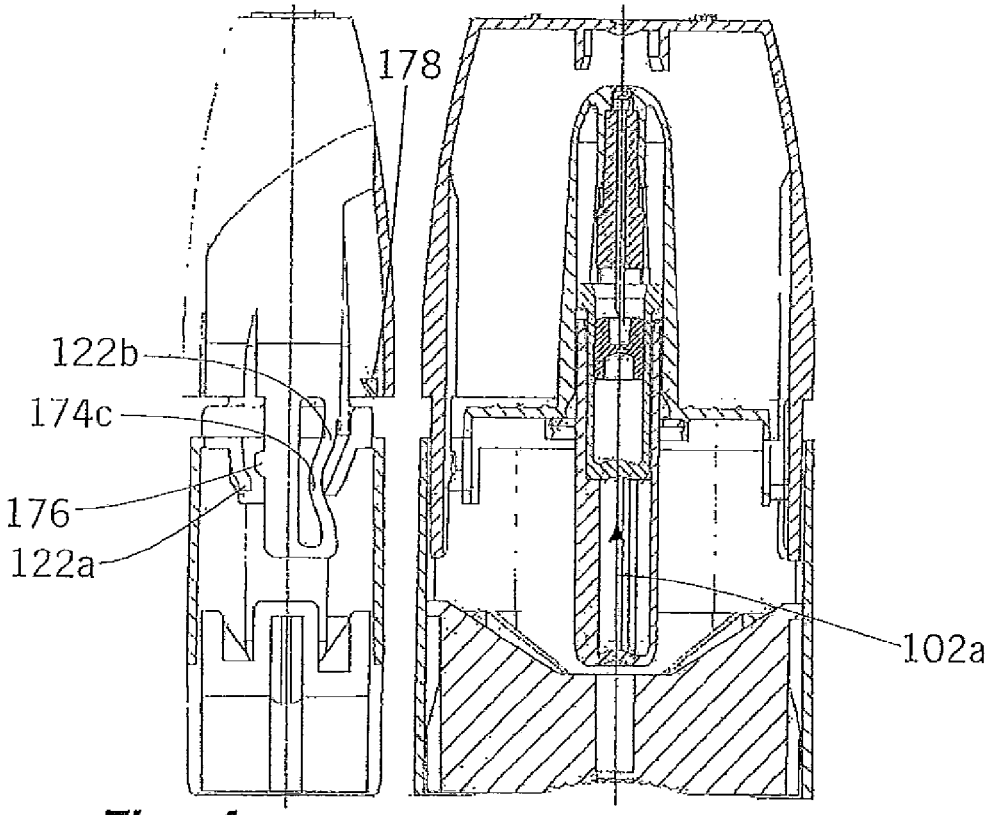
FIG. 4*c* shows sectional views of the discharging device of FIG. 3 wherein the cap is unlocked from the housing.
Figure 4D:
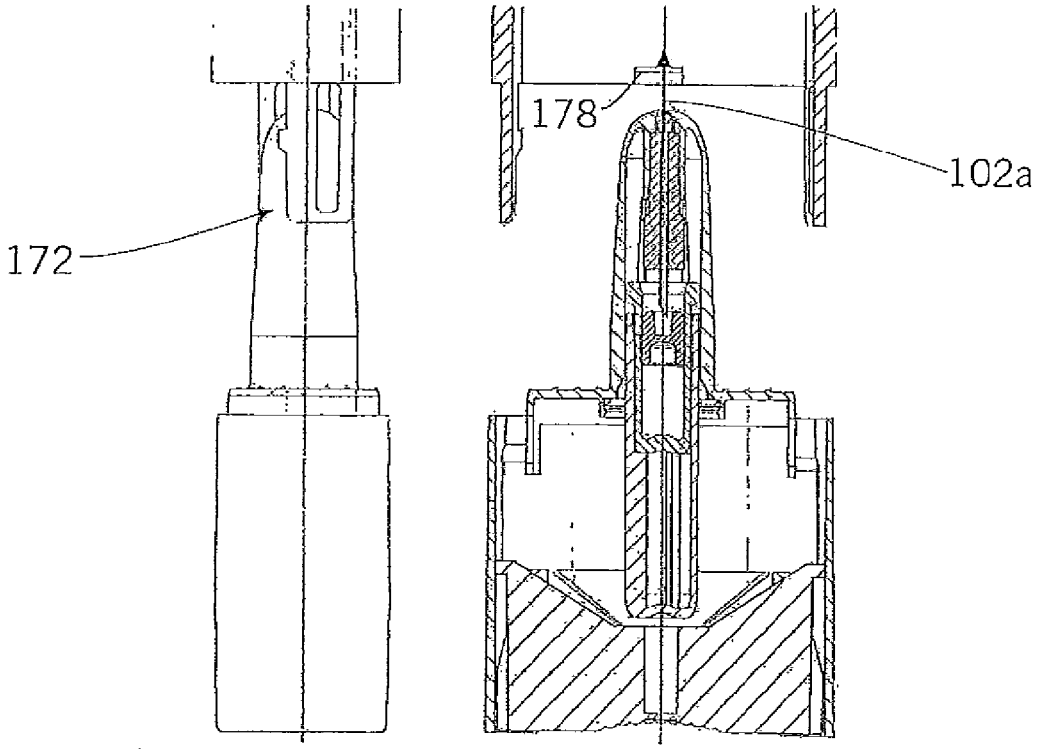
FIG. 4*d* shows sectional views of the discharging device of FIG. 3 with the cap removed from the housing.

When this rotated state of the cap shown in FIG. 4*b* is achieved, the undercut portion 176 can be guided past the left-side portion 122*a* of the hole 122 with the simultaneous application of force to the short sides 170*a* that causes the catches 178 to be lifted out of the recesses 124, and the cap 170 can thus be removed substantially in the pull-off direction 102*a* while being simultaneously rotated in the reverse direction relatively to the housing 110. This arrangement is shown in FIGS. 4*c* and 4*d*. After the removal of the cap 170, the discharging operation can take place in the manner described at the outset.

The invention claimed is:

1. A discharging device for discharging liquids, comprising:

an outer housing encompassing an inner chamber;

a liquid storage receptacle;

a discharge orifice;

a delivery device for delivering liquid from said liquid storage receptacle to said discharge orifice;

a cap that covers the discharge orifice when present on said outer housing in a safety position;

a manual actuator, which is adapted to actuate said delivery device and which can be moved relative to said outer housing between a neutral relative position and an actuated relative position, said cap and said manual actuator cooperating in such a manner that displacement of the manual actuator is mechanically blocked when said cap is in the safety position; and a plurality of locking extensions on said cap and extending in a pull-off direction of said cap, each of the locking extensions extending, in the safety position of said cap, through a hole in the outer housing for effecting blockage of said manual actuator in the inner chamber, and said locking extension and said hole being mutually configured in such that total removal of said cap from said outer housing in the pull-off direction starting from the safety position is only possible when said cap has beforehand been moved relative to said outer housing in an orthogonal plane oriented orthogonally to said pull-off direction from a locked state corresponding to said safety position to a released state;

wherein each of the locking extensions fit in the hole such that rotation of said cap about an axis parallel to the pull-off direction causes displacement of all of said locking extensions from the locked state to the released state in relation to said holes.

2. The discharging device according to claim 1, wherein:

each of said locking extensions has a main portion, which in the locked state of said cap is in alignment with said hole, as regarded in the pull-off direction, and an undercut portion is provided on each of said locking extensions, which is not in alignment with said hole in the locked state of said cap, as regarded in the pull-off direction.

3. The discharging device according to claim 2, wherein a force applying element is provided, which exerts a counter-force on said cap counteracting the displacement of said cap from the locked state to the released state.

4. The discharging device according to claim 3, wherein said force applying element is provided in the form of a resiliently deflectable fin on said cap or on each of said locking extensions of said cap, which fin, when said cap is moved from the locked state to the released state, is resiliently deflected by a counterpart that is immovable in relation to said outer housing.

5. The discharging device according to claim 2, wherein said cap and said outer housing are mutually configured in such a way that the displacement of said cap from the locked state to the released state is only possible when said cap has first been moved from the safety position in the pull-off direction.

6. The discharging device according to claim 1, wherein a force applying element is provided, which exerts a counter-force on said cap counteracting the displacement of said cap from the locked state to the released state.

7. The discharging device according to claim 6, wherein said force applying element is provided in the form of a resiliently deflectable fin on said cap or on each of said locking extensions of said cap, which fin, when said cap is moved from the locked state to the released state, is resiliently deflected by a counterpart that is immovable in relation to said outer housing.

8. The discharging device according to claim 7, wherein the plurality of locking extensions comprises a first locking extension and a second locking extension, the first locking extension including a first vertical portion and a first horizontal portion cantilevered from the first vertical portion adjacent a first bottom end of the first vertical portion and extending laterally in a first direction perpendicular to the pull-off direction, the second locking extension including a second vertical portion and a second horizontal portion cantilevered from the second vertical portion adjacent a second bottom end of the second vertical portion and extending laterally in a second direction perpendicular to the pull-off direction, and rotation of said cap about the axis moves the first vertical portion of the first locking extension out away from a first stop and the second vertical portion of the second locking extension out away from a second stop, the first direction being opposite to the second direction, with the first vertical portion of the first locking extension and the second vertical portion of the second locking extension extending laterally such that the first vertical portion of the first locking extension and the second vertical portion of the second locking extension do not extend inward toward the axis or outward away from the axis such that rotation of the cap allows the first vertical portion of the first locking extension to move out from under the first stop and the second vertical portion of the second locking extension to move out from under the second stop.

9. The discharging device according to claim 6, wherein said cap and said outer housing are mutually configured in such a way that the displacement of said cap from the locked state to the released state is only possible when said cap has first been moved from the safety position in the pull-off direction.

10. The discharging device according to claim 7, wherein said cap and said outer housing are mutually configured in such a way that the displacement of said cap from the locked state to the released state is only possible when said cap has first been moved from the safety position in the pull-off direction.

11. The discharging device according to claim 1, wherein said cap and said outer housing are mutually configured in such a way that the displacement of said cap from the locked state to the released state is only possible when said cap has first been moved from the safety position in the pull-off direction.

12. A discharging device for discharging liquids, comprising:

an outer housing encompassing an inner chamber;

a liquid storage receptacle;

a discharge orifice;

a delivery device for delivering liquid from said liquid storage receptacle to said discharge orifice;

a cap that covers the discharge orifice when present on said outer housing in a safety position;

a manual actuator, which is adapted to actuate said delivery device and which can be moved relative to said outer housing between a neutral relative position and an actuated relative position, said cap and said manual actuator cooperating in such a manner that displacement of the manual actuator is mechanically blocked when said cap is in the safety position; and a plurality of locking extensions on said cap and extending in a pull-off direction of said cap, each of the locking extensions extending, in the safety position of said cap, through a hole in the outer housing for effecting blockage of said manual actuator in the inner chamber;

wherein the plurality of locking extensions comprises a first locking extension and a second locking extension, the first locking extension including a first vertical portion and a first horizontal portion cantilevered from the first vertical portion adjacent a first bottom end of the first vertical portion and extending laterally in a first direction perpendicular to the pull-off direction, the second locking extension including a second vertical portion and a second horizontal portion cantilevered from the second vertical portion adjacent a second bottom end of the second vertical portion and extending laterally in a second direction perpendicular to the pull-off direction;

said locking extensions and said hole being mutually configured such that total removal of said cap from said outer housing in the pull-off direction starting from the safety position is only possible when said cap has beforehand been rotated about an axis of rotation parallel to the pull-off direction that moves the first vertical portion of the first locking extension out away from a first stop and the second vertical portion of the second locking extension out away from a second stop;

the first direction is opposite to the second direction, with the first vertical portion of the first locking extension and the second vertical portion of the second locking extension extending laterally such that the first vertical portion of the first locking extension and the second vertical portion of the second locking extension do not extend inward toward the axis of rotation or outward away from the axis of rotation such that rotation of the cap allows the first vertical portion of the first locking extension to move out from under the first stop and the second vertical portion of the second locking extension to move out from under the second stop.

13. The discharging device according to claim 12, wherein a force applying element is provided, which exerts a counter-force on said cap counteracting the displacement of said cap from a locked state to a released state.

14. The discharging device according to claim 13, wherein said force applying element is provided in the form of a resiliently deflectable fin on said cap or on each of said locking extensions of said cap, which fin, when said cap is moved from the locked state to the released state, is resiliently deflected by a counterpart that is immovable in relation to said outer housing.

15. The discharging device according to claim 14, wherein said cap and said outer housing are mutually configured in such a way that the displacement of said cap from the locked state to the released state is only possible when said cap has first been moved from the safety position in the pull-off direction.

16. The discharging device according to claim 12, wherein said cap and said outer housing are mutually configured in such a way that the displacement of said cap from a locked state to a released state is only possible when said cap has first been moved from the safety position in the pull-off direction.

17. The discharging device according to claim 13, wherein said cap and said outer housing are mutually configured in such a way that the displacement of said cap from the locked state to the released state is only possible when said cap has first been moved from the safety position in the pull-off direction.

* * * * *